US006312541B1

(12) United States Patent
Hemphill

(10) Patent No.: US 6,312,541 B1
(45) Date of Patent: Nov. 6, 2001

(54) METHOD AND APPARATUS FOR REPAIRING CONCRETE

(76) Inventor: W. Scott Hemphill, 220 Upper Pike Creek Rd., Newark, DE (US) 19711

( * ) Notice: Subject to any disclaimer, the term of this patent is extended or adjusted under 35 U.S.C. 154(b) by 0 days.

(21) Appl. No.: 09/439,650

(22) Filed: Nov. 12, 1999

(51) Int. Cl.[7] ..... B32B 35/00

(52) U.S. Cl. ..... 156/95; 156/91; 156/293; 52/745.21

(58) Field of Search ..... 156/66, 87, 91, 156/92, 94, 98, 293, 297; 403/267, 294; 404/68, 100, 70, 134; 264/36.2; 52/506.05, 514, 514.5, 707, 742.14, 742.15, 745.21

(56) References Cited

U.S. PATENT DOCUMENTS

| | | | | |
|---|---|---|---|---|
| 2,128,480 | | 8/1938 | Wertz . | |
| 2,494,869 | * | 1/1950 | Godwin | 248/205.3 |
| 3,532,316 | * | 10/1970 | Mathes | 404/60 |
| 3,915,582 | | 10/1975 | Clarke | 404/75 |
| 4,098,047 | | 7/1978 | Weber . | |
| 4,404,244 | | 9/1983 | Springston | 428/109 |
| 4,507,013 | | 3/1985 | Martinak | 404/75 |
| 5,171,100 | | 12/1992 | Bergstedt et al. . | |
| 5,309,692 | | 5/1994 | Hayashi et al. | 52/743 |
| 5,329,740 | | 7/1994 | Hayashi et al. | 52/514 |
| 5,464,303 | | 11/1995 | Wells | 404/75 |
| 5,476,340 | | 12/1995 | Contrasto | 404/75 |
| 5,492,431 | * | 2/1996 | Rasmussen et al. | 404/75 |
| 5,778,625 | | 7/1998 | Druffel et al. . | |
| 5,947,634 | * | 9/1999 | Robillard | 404/70 |
| 6,052,964 | * | 4/2000 | Ferm et al. | 52/742.14 |

FOREIGN PATENT DOCUMENTS

| | | | |
|---|---|---|---|
| 1-290875 | 11/1989 | (JP) | E04G/23/02 |

OTHER PUBLICATIONS

Article from Modern Plastics, Dec. 1955, pp. 98–100, 222.

* cited by examiner

*Primary Examiner*—Michael W. Ball
*Assistant Examiner*—Gladys Piazza
(74) *Attorney, Agent, or Firm*—Nilles & Nilles, S.C.

(57) ABSTRACT

A method and apparatus for repairing concrete structures utilize a generally flat composite material insert. The insert is inserted into a slot formed in a preexisting section of concrete and bonded to the preexisting section using an adhesive. The insert is installed such that a portion of the insert extends beyond the preexisting structure and into a void where damaged concrete has been removed and where the new concrete is to be poured. The insert then functions to join the preexisting section and the new concrete section. Alternatively, the insert may comprise an extension to attach an external fixture to the concrete section. Alternatively, a slot can be created within two preexisting concrete sections, adhesive added to the slot, and an insert installed in the slot. Again, the insert functions to join the two concrete sections.

16 Claims, 4 Drawing Sheets

METHOD AND APPARATUS FOR REPAIRING CONCRETE

BACKGROUND OF THE INVENTION

1. Field of the Invention

The present invention relates to repairing concrete and, more particularly, relates to a method and apparatus for joining concrete sections together.

2. Discussion of the Related Art

Over time, cracks can develop within concrete structures which, if left unrepaired, can result in failure of the structure. To prevent such an occurrence without having to replace an entire slab, damaged slabs are often repaired by cutting a damaged section away from a preexisting concrete section, and by pouring new concrete in its place. However, new concrete does not always bond perfectly with the preexisting concrete, and cracks can propagate in the joint between the two sections.

Previous methods have been implemented to repair concrete structures and maintain the mechanical connection between a new concrete section and a preexisting concrete section. One repair method involves first removing defective concrete and drilling holes in the preexisting concrete using a rotary impact hammer drill. An adhesive is then placed into the holes, and reinforcing bars are inserted such that the bars extend beyond the outer wall of the preexisting concrete and are generally perpendicular to the joint between the preexisting concrete section and the gap defining the area where the new concrete is to be poured. The new concrete is then poured adjacent the preexisting concrete such that the ends of the reinforcing bars extend into the new concrete and bond with the new concrete when it cures. Therefore, when the new concrete cures, it will be joined to the preexisting concrete via the reinforcing bars.

Additionally, when attaching external fixtures to preexisting concrete sections, holes are drilled using, e.g., a standard rotary drill, and anchors are either bonded or friction-fitted within the holes. The external fixtures are then mounted onto the anchors.

Several disadvantages are associated with these methods of repair and attachment. For example, drilling multiple holes into the existing concrete is a slow and labor intensive process. Additionally, the vibrations associated with the drilling can cause an entire section of concrete to fail. Moreover, once a hole is drilled, it must be subsequently cleaned of dust and concrete particles in order to permit the adhesive to bond to the concrete. In addition, cracks can form over time in the joint between the new section and the preexisting concrete. As moisture seeps down these cracks, a metallic reinforcing bar will rust, corrode, and subsequently fail, thereby necessitating further repair. Additionally, a phenomenon known in the industry as "burping" may occur, whereby air pockets become trapped within the hole once the reinforcing bar is installed, thereby preventing at least a portion of the adhesive from bonding with the reinforcing bar. This can lead to premature failure of the reinforced joint.

In another type of concrete structure, for example a parking garage structure, a concrete driveway is disposed above T-shaped concrete beams that are typically joined together by metal clips. As cracks form in the concrete, however, moisture seeps into the supports and corrodes the metal clips, ultimately causing them to fail. One previous method of repairing this type of structure involved welding or bolting a supplemental joining apparatus to both supports, thereby retaining them together. This method, however, is expensive and labor intensive. Additionally, the repair is aesthetically unappealing. Another method of repair involved cutting through the concrete to access and replace the failed metal clip. Again, this process is labor intensive and expensive.

The need has therefore arisen to provide an improved method and apparatus for repairing and/or adding external fixtures to concrete structures that retains the integrity of the preexisting concrete, that is not labor intensive, that does not corrode over time, and that resists premature failure.

OBJECTS AND SUMMARY OF THE INVENTION

It is therefore a first object of the present invention to provide a method and apparatus for repairing and/or attaching external fixtures to concrete that is not as labor intensive as previous repair systems.

It is a second object of the invention to provide an insert for repairing concrete that will not corrode over time.

It is a third object of the invention to provide an insert of a shape that allows the insert to mate with a slot within a preexisting section of concrete as opposed to a bore and that therefore does not require drilling holes into the existing concrete.

It is a fourth object of the invention to provide an insert that comprises cavities and/or texture to increase its bonding capabilities and resist premature failure.

It is a fifth object of the invention to provide a method and apparatus for repairing concrete while minimizing the risk of damaging the preexisting concrete during the repair process.

It is a sixth object of the invention to provide a method and apparatus for repairing two adjacent preexisting sections of concrete.

In accordance with a first aspect of the invention, the concrete to be replaced is removed by one of many known methods. A slot is then formed in the preexisting concrete, preferably with a diamond blade circular saw, in the surface that is adjacent and faces the area where the new concrete is to be added. Once the slot is created, an adhesive, preferably an epoxy compound, is inserted within it. A generally flat insert is then placed within the slot and is retained in place once the adhesive dries. A substantial part of the insert is exposed and extends from the preexisting concrete such that it will become immersed in newly poured concrete. The insert then bonds with the new concrete as it cures, thereby joining the two sections of concrete together.

In accordance with an alternate embodiment of the invention, the insert may comprise a threaded extension, extending generally perpendicular to the wall of concrete in which the insert is placed, that may be attached to a reinforcing bar or bars of a preexisting section of concrete, thereby joining the two concrete sections together. Alternatively, the insert may be installed into a preexisting concrete section, and the threaded extension may be used to support external fixtures, for example lights, while using the preexisting concrete as an anchor for the external fixtures.

In accordance with a second aspect of the invention, the insert is formed from a composite material such that moisture seeping into the joint between the new concrete and preexisting concrete will not corrode the insert.

In accordance with a third aspect of the invention, the insert may be a generally flat elongated object with an arcuate outer edge that is preferably configured to mate with the slot in the preexisting concrete. The generally flat insert also presents a relatively large exposed surface area to increase bonding with the adhesive and new concrete.

In accordance with a fourth aspect of the invention, the insert may have a textured exterior to help lock the insert in place when the adhesive and new concrete dry. Additionally, internal cavities may be created within the insert to permit the epoxy (on one end) and concrete (on the other end) to flow and cure within the cavities, thereby further strengthening the insert's retention in the concrete structure. The cavities also function to permit air to escape when the insert is set into the slot in the concrete to permit maximum bonding between the adhesive and the insert and to minimize the risk of premature failure.

In accordance with a fifth aspect of the invention, the slot within the preexisting concrete may be created with a circular diamond saw blade. As a result, dust and particles that are created during the cutting process are automatically ejected by the rotating diamond blade. The lack of significant vibration reduces the risk of damaging the existing concrete while creating the slot.

In accordance with a sixth aspect of the invention, an insert is usable to join two preexisting sections of concrete. A slot is first created into first and second sections to be joined, and an adhesive is then inserted into the slot. An insert having a shape preferably designed to mate with the slot is then inserted into the slot. This process is repeated until a sufficient number of inserts have been installed to support the joint of the two concrete sections. When the adhesive dries, the insert(s) will function to support the joint between the sections.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENT

Pursuant to a preferred embodiment of the invention, a preexisting section of concrete remains after damaged or defective concrete has been removed from a structure creating a void. To repair the structure, a slot is created within the preexisting section at its outer wall or exposed surface adjacent and facing the area or void where new concrete is to be added, and an adhesive is inserted into the slot. One end of a generally flat composite material insert is inserted into the slot such that the other end extends from the wall or exposed surface. Liquid concrete is then poured into the void, and covers the exposed end of the insert. Several inserts may be installed, depending on the application, such that, when the adhesive and new concrete dry, the inserts function to join the two sections of concrete together. A similar method and insert may be employed to join two preexisting sections of concrete. In this embodiment, a slot is created in the two sections, and adhesive is inserted into the slot. An insert is then placed within the slot to join the two sections of concrete when the adhesive dries.

Figure 1:
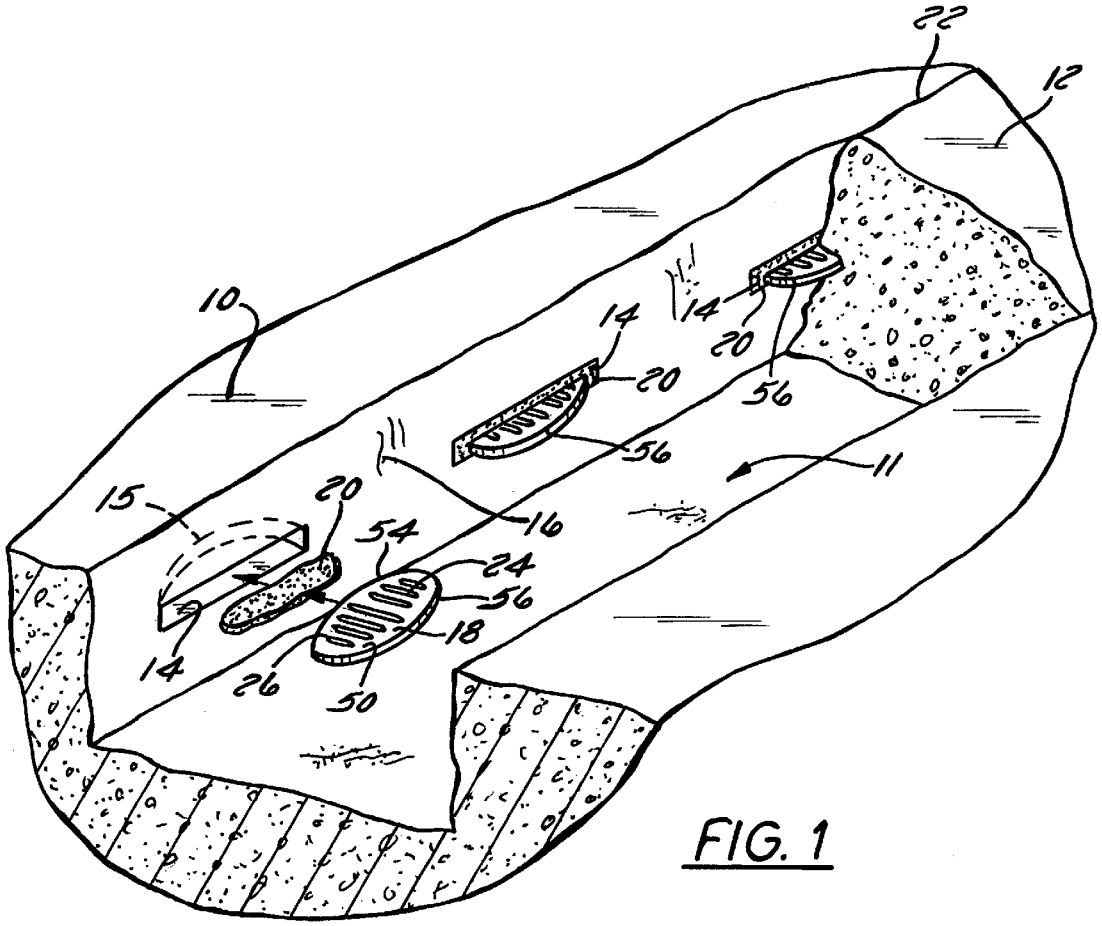
FIG. 1 is a partially exploded fragmentary perspective view in cross section of a section of concrete to be repaired in accordance with a first embodiment of this invention.

Referring to FIG. 1, a preexisting concrete section 10 is shown with a damaged section removed creating a void 11 in the section. Before pouring a new section of concrete 12 into the void 11 to bond with the preexisting section 10, a slot 14 is first created in wall 16 and extends into the preexisting section a predefined depth. The elongated slot 14, while shown as being generally horizontal and longitudinally extending generally parallel to wall 16, may be formed at any orientation and angle as long as an insert 18 has one end extending into the void. Preferably, the slot 14 is created using a circular diamond saw blade having a known radius of curvature. The insert 18 is formed having a curved surface, defined below, that at least approximates the radius of the slot 14. The rotation of the blade expels most of the removed material from the slot 14, thereby reducing or eliminating the need to clean the slot of dust and debris created during the cut. The insert 18 may be made in a variety of sizes such that a curved side or edge 54 or 56 of the insert will substantially mate with slots formed by various size saw blades. The slot 14 is preferably generally perpendicular to the wall 16 such that, when an insert 18 is placed within the slot, one end of the insert extends beyond the wall a maximum distance into the void 11 where the new concrete 12 is to be poured. The insert 18 then extends laterally perpendicular to the wall 16 when disposed within the slot 14.

Figure 2:
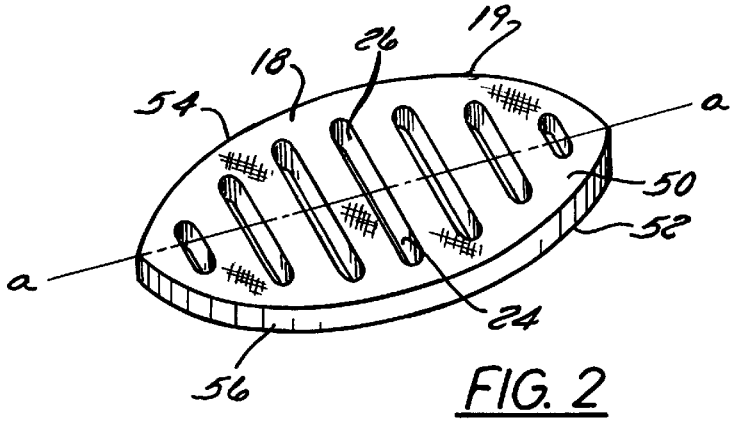
FIG. 2 is a perspective view of a concrete repair insert constructed in accordance with a preferred embodiment of the present invention.

Before or after the insert 18 is inserted into the slot 14, adhesive 20 is added into the slot. Preferably, the adhesive 20 is an epoxy compound, although any compound that is capable of bonding with concrete and composites will suffice. The adhesive will be referred to throughout this application as an epoxy for the sake of simplicity and consistency. In the preferred embodiment, the epoxy 20 is inserted into the slot 14, and the insert 18 is then placed within the slot such that it becomes immersed in the unhardened epoxy. If necessary, the insert 18 may be removed and inserted a few times to insure that the epoxy 20 covers the entire end of the insert disposed in the slot 14. As a result, when side or edge 54 or 56 of the insert 18 is seated against an inside wall 15 of the slot 14, a portion of the insert extends beyond the wall 16 and into the void 11 where the new concrete 12 is to be poured. Preferably, the insert 18 is generally symmetrical along line a—a as shown in FIG. 2 to permit either side of the insert 18 to be inserted into the slot 14 and to permit approximately half of the insert 18 to be disposed in the preexisting concrete 10 and the other half to be disposed in the new concrete section 12. A plurality of inserts 18 may be installed in the preexisting structure to reduce the stress upon each individual insert. Once the inserts 18 are installed, the new concrete is then poured into the void 11 forming a joint 22. When the epoxy 20 and new concrete 12 dry, the insert(s) will bond to both the new section 12 and preexisting section 10 of concrete and support the resulting joint 22 between the two sections.

Alternatively, a plurality of inserts may be connected to each other by an elongated composite beam to form a string of inserts. In this embodiment, the inserts are spaced at a predefined distance, and slots are created in the wall 16, spaced at the same distance. Epoxy may then be added to the slots, and then each insert installed into the respective slot generally simultaneously. New concrete is then poured as described previously.

Referring specifically to FIG. 2, the insert 18 is of a relatively thin, elongated oblong-shaped structure having first and second major surfaces 50 and 52 and first and second arcuate sides or edges 54 and 56 that are symmetrical about a major axis a—a of the structure. The edges 54 and 56 each have a radius of curvature that at least approximates the radius of curvature of the saw blade used to cut the slot 14. As a result, the peripheral shape of either edge 54 or 56 at least approximates the shape of the periphery of the slot 14. The major surfaces 50 and 52 of the insert 18 also may be textured to improve bonding of the insert 18 with the epoxy 20 and new concrete 12 and to reduce the chance that the insert 18 will become mechanically disengaged from either the preexisting section 10 or the new section 12 during use. This texturing may take the form of ridges, dimples, or any other rough or uneven surface topography.

Figure 3:
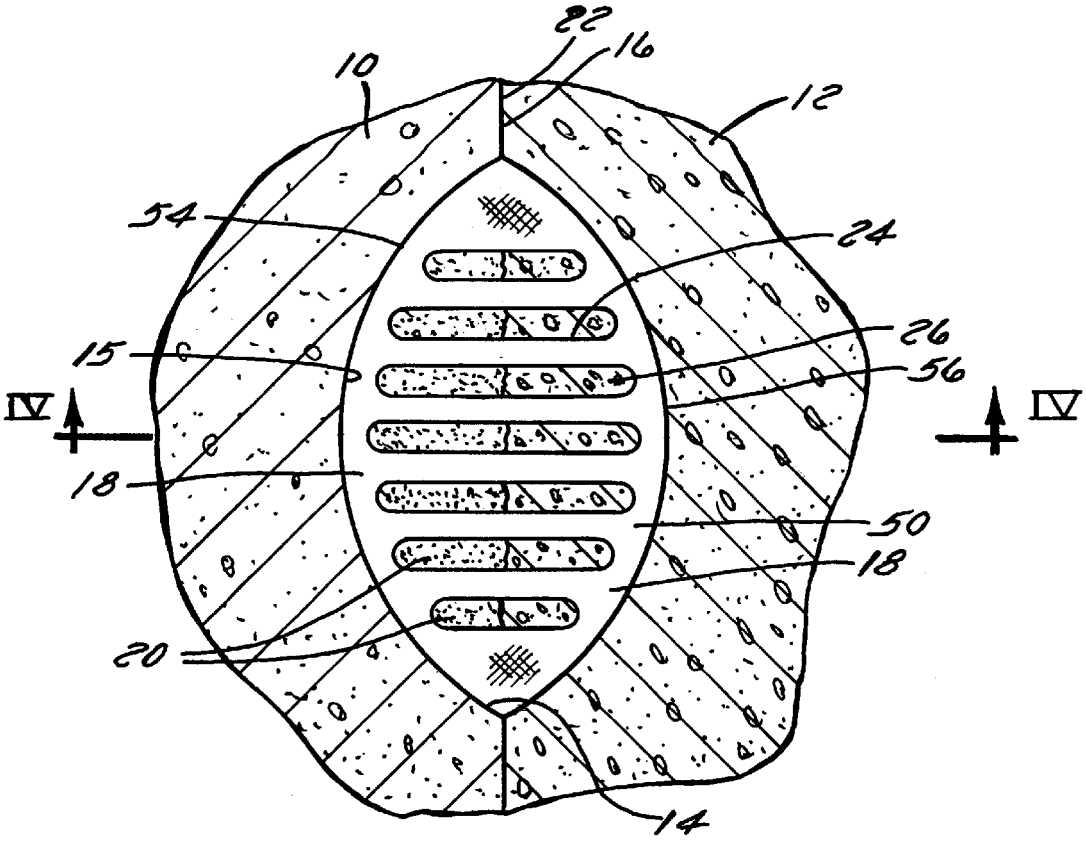
FIG. 3 is a sectional top plan view of an insert shown in FIGS. 1 and 2 and embedded in new concrete and preexisting concrete sections.
Figure 4:
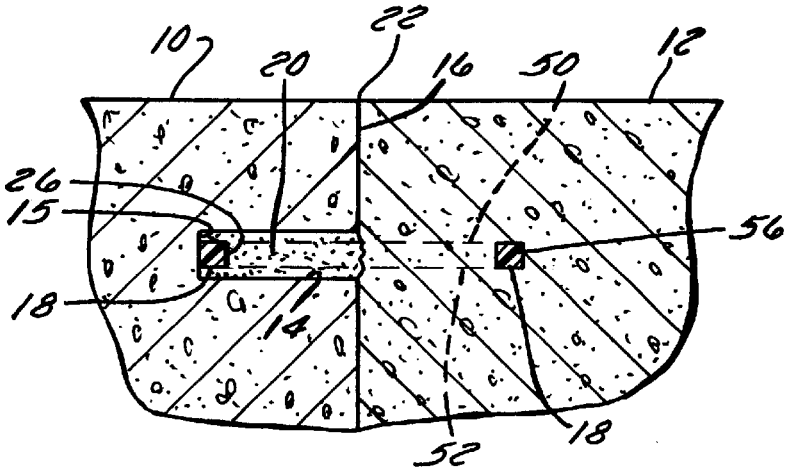
FIG. 4 is a side sectional elevation view of the insert taken along line IV—IV of FIG. 3.

The insert 18 also may have interior walls 24 that define cavities 26 formed in the major surfaces 50 and 52 that extend into, and preferably through, the insert 18 to allow the epoxy 20 and new concrete 12 to flow into the cavities 26 and bond to the insert, as shown in FIGS. 3 and 4. The cavities 26 may be one of any size and shape as long as they function to increase bonding of the epoxy 20 and/or new concrete 12 to the insert 18 without unduly reducing the strength of the insert. As an additional advantage of the cavities 26, air is able to escape from the slot 14 through the cavities as the insert 18 is installed. If the air was unable to escape, the epoxy would not maximize its bonding potential due to the air gaps.

The insert 18 preferably is formed from a corrosion-resistant composite material such that, if cracks form in the joint 22 over time, the insert 18 will resist corrosion from any moisture that may seep into the crack. Any material that resists corrosion and is capable of bonding to both adhesives and concrete could be used. In one preferred embodiment, the insert 18 is formed from a molded thermoplastic material reinforced with fibers of glass, carbon, or the like. When an insert 18 of this type is molded, the major surfaces 50 and 52 can become textured as described above where the embedded fibers within the insert 18 form ridges in the major surfaces. Additionally, the mold may comprise indentations, thereby forming dimples on the exterior of the insert 18 during the molding process.

Figure 7:
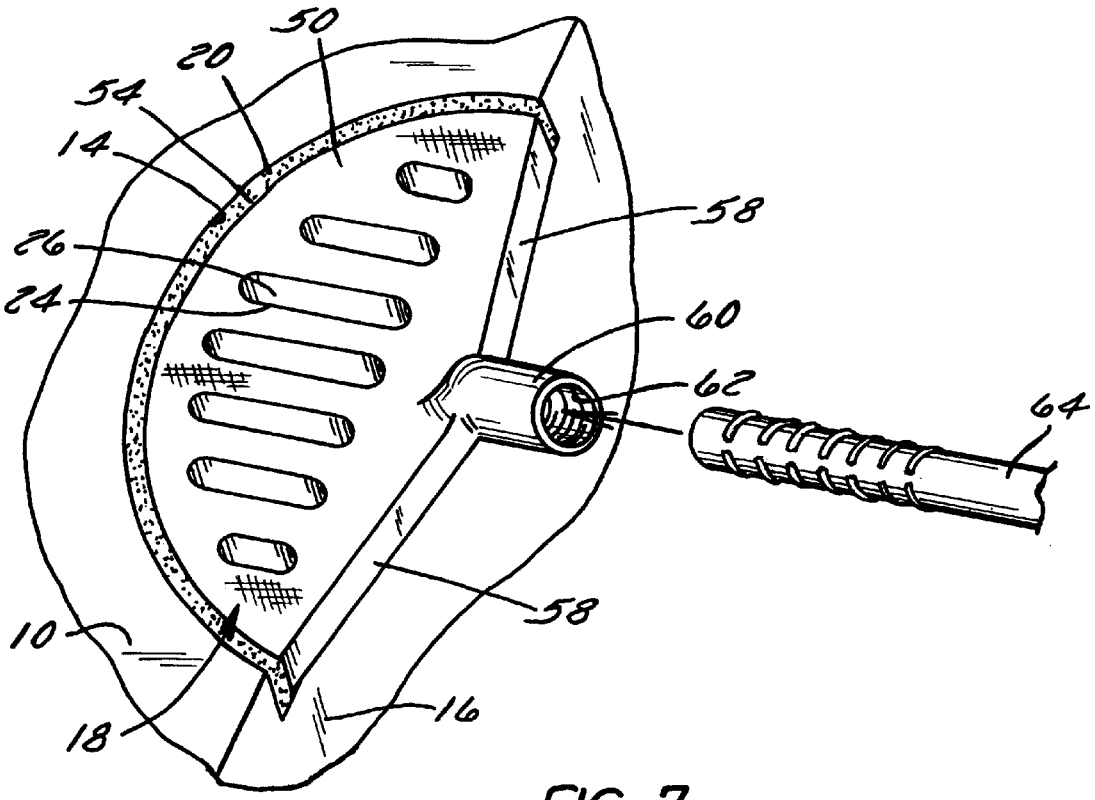
FIG. 7 is a sectional side elevation view of an insert in accordance with another embodiment of this invention.

An alternate embodiment of the insert 18, shown in FIG. 7, further comprises a generally cylindrical extension 60 protruding outwardly from surface 58, and having a fitting for attachment to coil rods, bolts, and the like. The fitting may comprise internal threads 62 as illustrated, external threads, or any other fitting. Surface 58 is angled outwardly in a shallow "V" shape to provide additional support for the extension 60. The extension is preferably located at the apex of the "V".

To repair a concrete structure in accordance with this embodiment, the insert 18 is installed into a preexisting concrete section 10 as described above, such that the threaded extension 60 protrudes generally perpendicularly from the wall 16 of the preexisting concrete 10. The extension 60 is then connected to a reinforcing bar 64 using an adapter (not shown) that is mounted onto the reinforcing bar at one end and having external threads at the other end to mount onto the extension 60. Alternatively, the reinforcing bar 64 could comprise threads to mate with the extension 60. Once the insert 18 and preexisting reinforcing bar 64 are connected, new concrete is poured to immerse the reinforcing bar 64 within the new concrete section. In another embodiment (not shown), the reinforcing bar 64 may be predisposed within a preexisting concrete section, in which case the insert 18 is connected to the reinforcing bar, and new concrete is poured to immerse the insert within the new concrete.

Alternatively, the insert of FIG. 7 may be used to attach an apparatus, having external attachment threads, onto the extension 60 of the insert 18 that has been installed in the preexisting concrete section 10. For example, if a plurality of inserts 18 is installed onto a ceiling of a parking garage structure such that the extensions 60 protrude downwardly, light fixtures having external threads may be attached to the extensions.

Figure 5:
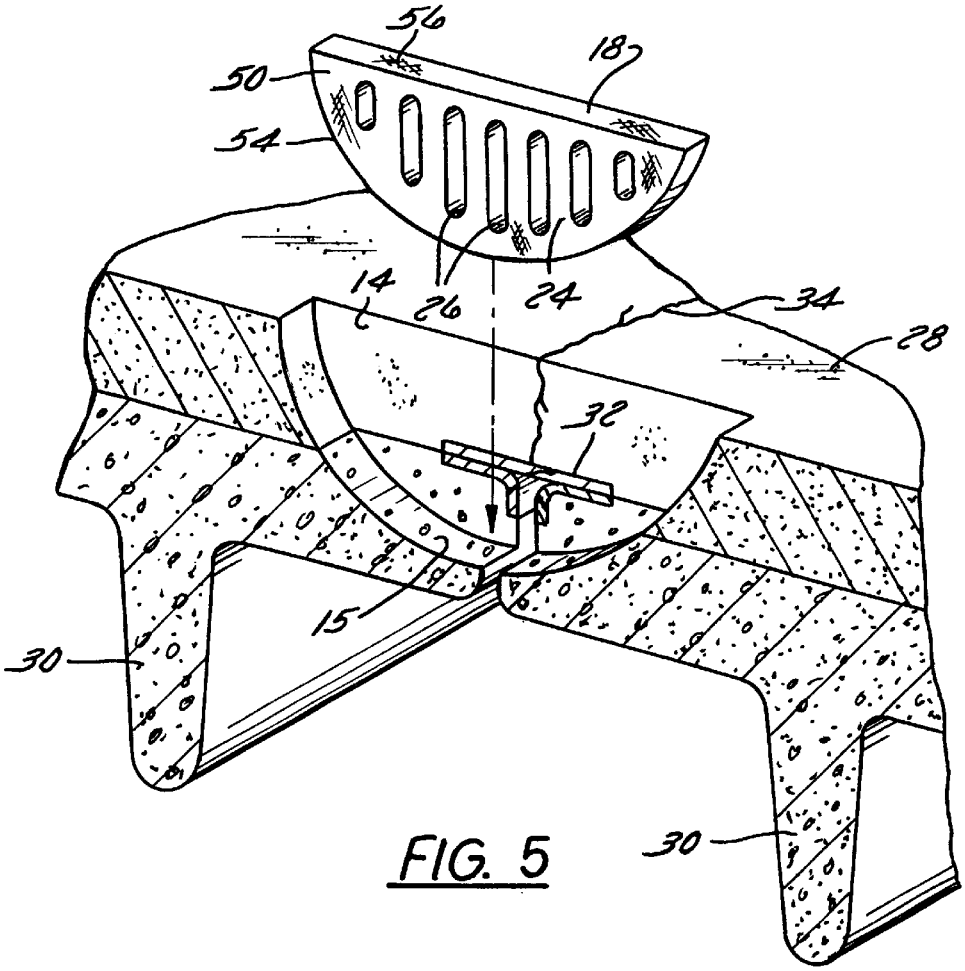
FIG. 5 is a fragmentary perspective view in cross section of two preexisting sections of concrete to be joined in accordance with another embodiment of this invention.
Figure 6:
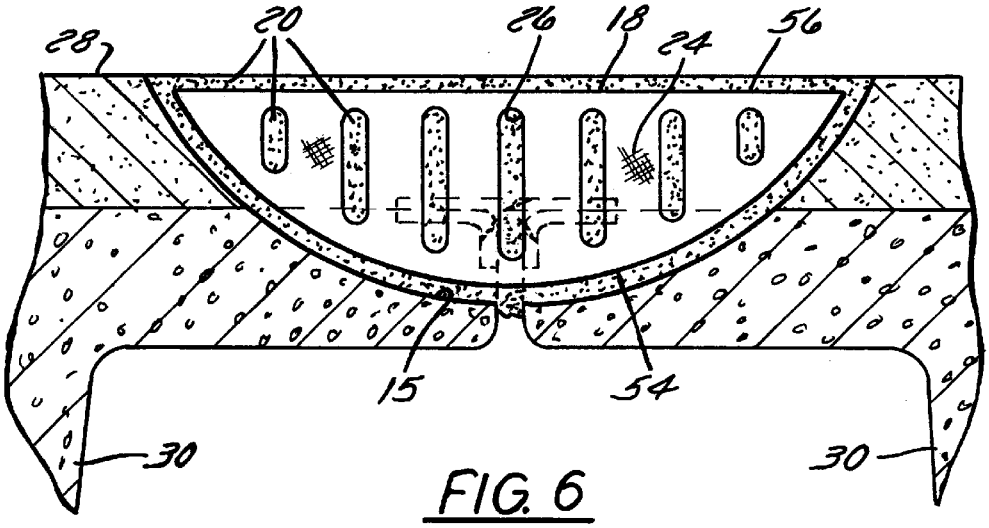
FIG. 6 is a sectional side elevation view of the preexisting sections of concrete of FIG. 5 joined by an insert in accordance with a second embodiment of the present invention.

An additional application for the insert is illustrated in FIGS. 5 and 6, which show a typical parking structure comprising a concrete deck 28 disposed above concrete T-shaped planks 30. The structure is further supported by metal clips 32 that join the planks 30 together. However, the metal clips 32 have failed in these Figures as a result of corrosion from moisture that has seeped into cracks 34 that have developed in the deck 28. To rejoin the sections together, slot 14 is created, again preferably using a circular diamond saw blade, through the deck 28 and partially into the T-shaped planks 30. Epoxy 20 is then inserted into the slot 14, followed by the composite insert 18. When the epoxy dries, it bonds with both concrete planks 30 as well as the insert 18, thereby retaining the planks 30 in place relative to each other. To conform to this application, the insert 18 is truncated generally along major axis a—a to form a portion of the elongated shape described above. The side or edge 56 of the insert 18 may be generally flush with the deck 28 when installed, or disposed slightly below the deck 28. Side or edge 54 is of a chosen radius of curvature to approximate the radius of the saw blade used to cut slot 14. This method of repair is applicable to any concrete section that is to be joined to a second concrete section.

Many changes and modifications may also be made to the invention without departing from the spirit thereof. The scope of these changes will become apparent from the appended claims.

I claim:

1. A method of repairing concrete comprising:

(A) creating an elongated slot in a wall of an existing concrete section having a top surface, said slot being elongated generally along said wall, wherein said wall is generally perpendicular to said top surface;

(B) inserting an adhesive into said slot;

(C) placing an insert into said slot, wherein said adhesive retains said insert within said slot; and (D) bonding said insert within said slot using said adhesive.

2. The method of claim 1, further comprising:

pouring new concrete adjacent said wall to immerse said insert in said new concrete; and curing said new concrete so that said insert joins said existing concrete section to said new concrete.

3. The method of claim 2, wherein said adhesive is added to said slot prior to inserting said insert.

4. The method of claim 2, wherein said adhesive is added to said slot after inserting said insert.

5. The method of claim 2, said insert having a non-cylindrical shape.

6. The method of claim 2, wherein said insert is formed from a composite material that is resistant to corrosion by water.

7. The method of claim 2, wherein step (C) further comprises forming said slot so that said insert extends generally longitudinally along said wall.

8. The method of claim 2, further comprising creating texture on an exterior of said insert to increase bonding of said adhesive and new concrete with said insert.

9. The method of claim 2, further comprising forming cavities in said insert to increase bonding of said adhesive and new concrete with said insert.

10. The method of claim 2, wherein step (A) further comprises cutting said slot in said wall with a rotary saw blade.

11. The method of claim 10, further comprising cutting said slot to have a shape generally approximating a shape of the rotary saw blade.

12. The method of claim 2, wherein step (C) further comprises placing said insert into said slot, wherein said insert generally follows a contour of said slot.

13. The method of claim 2, further comprising removing damaged concrete from said existing concrete section to form a void in said wall of said existing concrete section.

14. The method of claim 2, further comprising pouring said new concrete into an existing void.

15. A method of joining a first concrete section to an adjacent second concrete section defining a void therebetween, the method comprising:

(A) creating an elongated slot in a wall of at least one of the first and second concrete sections, the wall being generally perpendicular to a top surface of the at least one concrete section, and the slot being elongated generally along said wall;

(B) placing an insert into said slot; and (C) pouring new concrete into the void to immerse said insert in said new concrete.

16. The method of claim 15, further comprising the step of applying an adhesive in said slot to enhance bonding of the at least one concrete section with said insert.

* * * * *